US010460707B2

(12) United States Patent
May

(10) Patent No.: US 10,460,707 B2
(45) Date of Patent: Oct. 29, 2019

(54) MAGNETIC THROW-OFF FLOATING ATTACHMENT

(71) Applicant: Randall May International, Inc., Irvine, CA (US)

(72) Inventor: Randall L. May, Irvine, CA (US)

(73) Assignee: Randall May International, Inc., Irvine, CA (US)

( * ) Notice: Subject to any disclaimer, the term of this patent is extended or adjusted under 35 U.S.C. 154(b) by 0 days.

(21) Appl. No.: 15/895,833

(22) Filed: Feb. 13, 2018

(65) Prior Publication Data

US 2018/0174557 A1 Jun. 21, 2018

Related U.S. Application Data

(63) Continuation of application No. 15/454,692, filed on Mar. 9, 2017, now Pat. No. 9,928,816, which is a continuation of application No. 15/157,330, filed on May 17, 2016, now Pat. No. 9,633,634.

(60) Provisional application No. 62/165,644, filed on May 22, 2015.

(51) Int. Cl.
*G10D 13/02* (2006.01)

(52) U.S. Cl.
CPC ..... *G10D 13/025* (2013.01); *G10D 13/026* (2013.01)

(58) Field of Classification Search
CPC ..... G10D 13/025; G10D 13/026
See application file for complete search history.

(56) References Cited

U.S. PATENT DOCUMENTS 3,812,629 A * 5/1974 Campbell ..... B23Q 3/152 269/8
4,055,824 A * 10/1977 Baermann ..... B23Q 3/152 335/288
4,251,791 A * 2/1981 Yanagisawa ..... H01F 7/04 335/285
4,730,532 A * 3/1988 Bauerfeind ..... G10D 13/065 84/422.1
4,945,330 A * 7/1990 Arita ..... H01F 7/021 310/13
5,038,062 A * 8/1991 Shiraki ..... H02K 41/02 310/36
5,266,914 A * 11/1993 Dickson ..... B25B 11/002 269/8

(Continued)

FOREIGN PATENT DOCUMENTS

EP 1 923 862 A2 5/2008
GB 1146091 A * 3/1969 ..... G10D 13/025
WO WO-2015091166 A1 * 6/2015 ..... G10D 13/025

*Primary Examiner* — Robert W Horn
(74) *Attorney, Agent, or Firm* — Crowell & Moring LLP

(57) ABSTRACT

A snare drum attachment is disclosed. A mounted body is mounted to the snare drum and houses a first magnet. A moveable body is coupled to the mounted body. The moveable body is configured to retain tensioned snares a set distance from a snare head of the snare drum. The moveable body houses a second magnet magnetically coupled to the first magnet so as to generate a magnetic force. A manual actuator is coupled to the first magnet. Actuation of the manual actuator alters the magnetic force so as to displace the moveable body relative to the mounted body. The displacement changes the set distance of the tensioned snares from the snare head.

20 Claims, 10 Drawing Sheets

(56) References Cited

U.S. PATENT DOCUMENTS 5,302,872 A * 4/1994 Ohki ..... H02K 41/031 310/12.19
5,934,629 A * 8/1999 Peritz ..... G10D 13/06 248/121
7,012,495 B2 * 3/2006 Underwood ..... B23Q 3/1546 269/8
7,671,263 B1 * 3/2010 Coady ..... G10D 13/065 84/422.3
7,902,444 B1 * 3/2011 Good ..... G10D 13/025 84/411 R
8,143,507 B2 * 3/2012 Good ..... G10D 13/025 84/413
8,256,098 B2 * 9/2012 Michael ..... H01F 7/04 29/607
8,350,663 B1 * 1/2013 Michael ..... H01F 7/0226 338/288
8,823,477 B2 * 9/2014 Malanczyj ..... H01F 7/04 269/8
9,269,337 B2 * 2/2016 Sato ..... G10D 13/026
9,631,652 B2 * 4/2017 Krol ..... F16M 13/022
9,633,634 B2 * 4/2017 May ..... G10D 13/026
9,773,481 B1 * 9/2017 Goldsmith ..... G10D 13/026
9,870,761 B2 * 1/2018 Spencer ..... G10D 13/026
9,928,816 B2 * 3/2018 May ..... G10D 13/025
9,934,764 B2 * 4/2018 Jones ..... G10D 13/00
10,096,309 B2 * 10/2018 Suitor ..... G10H 3/188
10,157,600 B2 * 12/2018 Goldsmith ..... G10D 13/026
2006/0060062 A1 * 3/2006 Dyk ..... G10D 13/006 84/422.1
2007/0133156 A1 * 6/2007 Ligtenberg ..... G06F 1/1616 361/679.27
2008/0034944 A1 * 2/2008 Aspland ..... G10D 13/006 84/415
2008/0061565 A1 * 3/2008 Lee ..... E05C 19/16 292/251.5
2008/0115652 A1 * 5/2008 Abe ..... G10D 13/025 84/416
2013/0291706 A1 * 11/2013 Van Dyk ..... G10D 13/006 84/422.3
2014/0026736 A1 * 1/2014 Sato ..... G10D 13/026 84/421
2014/0306463 A1 * 10/2014 Ho ..... E05C 19/16 292/251.5
2017/0017273 A1 * 1/2017 Weldon ..... G06F 1/1681
2017/0061942 A1 * 3/2017 Spencer ..... G10D 13/065
2017/0124994 A1 * 5/2017 Strickland ..... G10D 13/022
2017/0178608 A1 6/2017 May
2017/0249929 A1 * 8/2017 Bedson ..... G10D 13/023
2018/0174557 A1 * 6/2018 May ..... G10D 13/025
2018/0240444 A1 * 8/2018 Israel ..... G10H 3/143
2018/0311795 A1 * 11/2018 Morton ..... G01R 33/02

* cited by examiner

MAGNETIC THROW-OFF FLOATING ATTACHMENT

CROSS REFERENCE TO RELATED APPLICATIONS

This application is a continuation of application Ser. No. 15/454,692, filed Mar. 9, 2017 which is a continuation of Ser. No. 15/157,330, filed May 17, 2016, which claims the benefit of application Ser. No. 62/165,644 filed May 22, 2015, the entire contents of which is hereby expressly incorporated by reference herein.

BACKGROUND OF THE INVENTION

The disclosure relates to improvements in snare drum throw-off and attachment mechanisms.

By way of background, a snare drum is constructed of two opposing drum heads along with a rattle of typically metal wires (i.e., the snares) extending on a drum head (e.g., the bottom or resonant head) that alters the sound of the drum when the drum is struck. Some snare drums include snare throw-off systems, sometimes called strainers, for engaging and disengaging the snare wires onto and off of the drum head, as well as for adjusting the snare wire pressure against the drum head. Drummers often disengage (i.e., elevate) a snare off of the drum head to create a different sound. Snare throw-off systems may also include a tensioning system for tightening or loosening the snare wire.

Exemplary snare drums and snare throw-off systems are described in the following U.S. Pat. No. and Publications: 5,557,053; 6,846,978; 2006/0219084; 2009/0133564; 7,902,444; and 8,143,507, each of which is hereby incorporated by reference as exemplary background.

Typical snare drum throw-off systems, however, include several disadvantages. They are large, heavy and complex, using mechanical leverage structures with rivets and other components that loosen and rattle over time. The size, added weight and rattling of these structures is undesirable. The mechanical leverage structures are also complex to disassemble, making maintenance uneasy.

The mechanical leverage structures also interfere with the sound quality of the snare drum in another way. Due to the mechanical coupling of the snare to the throw-off, a residual vibration is transferred to the snare wires from the throw off via the drum shell when the drum is played. This residual vibration impacts the intended primary vibration of the snare wires caused by the energy of the played drum head, resulting in poorer sound quality.

Drummers also often desire to change the snare drum head quickly, for example, as part of a performance to create a different sound or fix a damaged drum head. The complexity and arrangement of traditional throw-off systems hinder such quick replacement.

Traditional throw-off systems, specifically snare wire strainer, must be removed from the drum in order for the head to be replaced. Removal also negatively impacts the tuning presets of the snare throw-off system and subsequently needs to be restored.

Tuning the snare drum typically involves first tuning the drum heads without the snares attached. Once the drum head is tuned, the snares are attached and are themselves tuned via adjustment of the snare wire tension and the snare pressure on the drum head. While the snare drum is usually played with the snare facing downward, tuning typically occurs with the snare facing upward. Mechanical throw-off systems tend to utilize the force of gravity in spacing the snares from the drum head when in the snare side down orientation. When in the snare side up tuning orientation, however, those same snares tend to fall to the drum head. This negatively affects the ability of the drummer to tune the snares.

It is therefore desirable to provide advantages over such systems. Other features and advantages of the present invention will become apparent from the following more detailed description, taken in conjunction with the accompanying drawings, which illustrate, by way of example, the principles of the presently described embodiments.

BRIEF DESCRIPTION OF THE DRAWING(S)

DETAILED DESCRIPTION OF THE PREFERRED EMBODIMENTS

Figure 1:
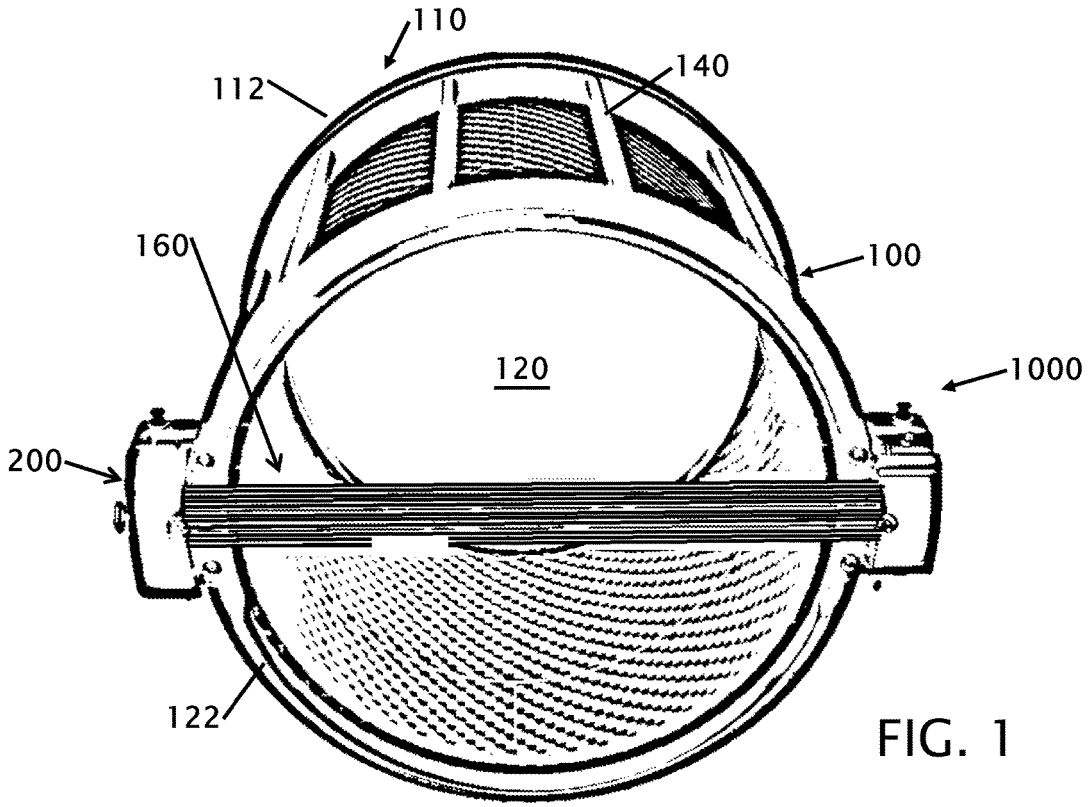
FIG. 1 shows a drum equipped with the magnetic throw-off and floating attachment according to at least one embodiment.

The above described drawing figures illustrate the disclosed invention in at least one of its preferred, best mode embodiment, which is further defined in detail in the following description. Those having ordinary skill in the art may be able to make alterations and modifications to what is described herein without departing from its spirit and scope. While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspects of the invention to any embodiment illustrated. Therefore, it should be understood that what is illustrated is set forth only for the purposes of example and should not be taken as a limitation on the scope of the disclosed invention.

Figure 2:
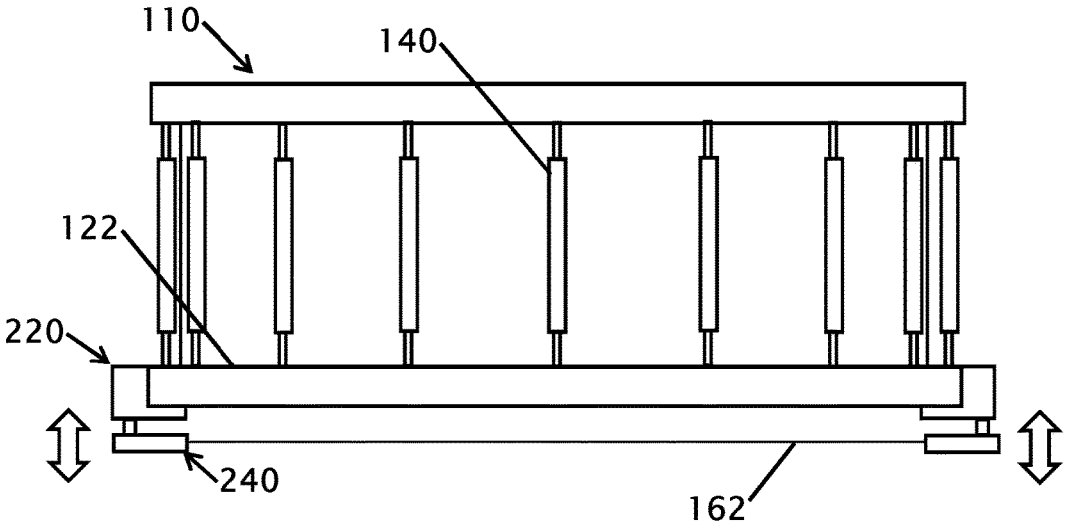
FIG. 2 shows a drum equipped with the magnetic throw-off and floating attachment according to at least one embodiment.
Figure 3:
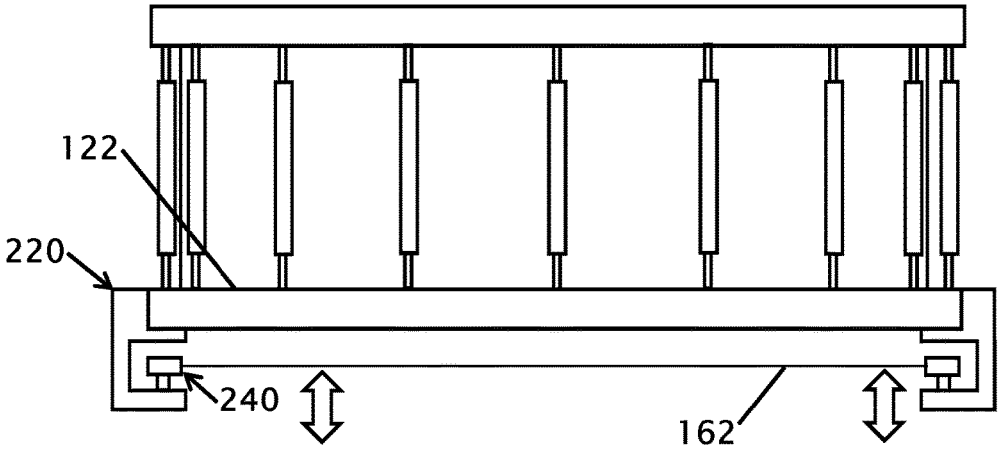
FIG. 3 shows a drum equipped with the magnetic throw-off and floating attachment according to at least one embodiment.

FIGS. 1-3 illustrate an exemplary snare drum 100 having a magnetic throw off and floating attachment 1000 according to at least one embodiment of the disclosed invention.

The snare drum includes a batter head 110 and a snare head 120 positioned on either ends of a drum shell 130. Each of the batter head and the snare head includes respective hoops 112 and 122. Tension rods 140 secure the hoops, and respective heads, to the drum shell.

The magnetic throw-off and floating attachment is secured to the drum proximate the snare head. The magnetic throw-off and floating attachment generally includes a magnetic throw-off 200 and a floating attachment 400.

Snares 160 are coupled to the magnetic floating snare drum attachment so as to be suspended across the snare head. In at least one embodiment, the snares are suspended between opposing magnetic floating snare drum attachments. In at least one other embodiment, the snares are suspended between the magnetic floating snare drum attachment and a snare butt (not shown), or other similar structure.

The magnetic floating snare drum attachment is generally secured to the drum proximate the snare head and is operatively configured to raise and lower the snares between an elevated state, in which the snares are further from the snare head, and an engaged state, in which the snares are closer to the snare head, at least in part based on a magnetic attractive and/or repulsive force. The magnetic floating snare drum attachment is preferably secured to the snare head hoop.

The magnetic throw-off generally includes a mounted portion 220 and a moveable portion 240. The mounted portion is secured to the drum proximate the snare head. The moveable portion is operatively coupled to the mounted portion so as to raise and lower the snares between an elevated state, in which the snares are further from the snare head, and an engaged state, in which the snares are closer to the snare head, at least in part based on a magnetic attractive and/or repulsive force. This magnetic coupling translates into a shock-absorber effect for the snares, with the result of better sound quality due to reduced vibratory interference from the magnetic throw-off to the snares. In other words, when in the elevated state, the moving portion 'floats' in a sense on the mounted portion via the magnetic force.

FIGS. 2-3 illustrate the magnetic throw-off according to several embodiments of the disclosed invention.

FIG. 2 shows an exemplary embodiment in which the mounted portion is secured to the snare head hoop and the moveable portion is generally displaceable towards and away from the mounted portion. The arrows illustrate the movement of the moveable portion, and the corresponding movement of the snares, towards and away from the snare head. It will be appreciated, however, that the configuration is shown in exaggeration for clarity and is not intended as being to scale.

FIG. 3 shows an exemplary embodiment in which the mounted portion is secured to the snare head hoop and the moveable portion is generally displaceable between opposing ends of the mounted portion. As illustrated for example in FIG. 3, the mounted portion may include an extension that defines a concavity in which the moveable portion is positioned.

It will be understood that the magnetic floating snare drum attachment may include any configuration of mounted and moveable portions. The exemplary embodiments shown in FIGS. 2-3 for the purpose of illustrating aspects of the inventive concept.

Turning now to FIGS. 4-9, the magnetic throw-off is configured to lift and lower the snares at least in part due to magnetic attractive and/or repulsive force. The magnetic throw-off is therefore preferably configured such that the action of the magnetic attractive and/or repulsive force causes the relative displacement of the moving portion towards and away from the mounted portion. To that end, the magnetic throw-off includes a magnet arrangement 300 and a constraint system 350 operatively configured to enable and control the relative displacement of the moving portion towards and away from the mounted portion. The snares suspended from the moving portion are thereby raised and/or lowered with respect to the snare head.

The magnetic coupling thus separates the lineal tension of the snare wires from the action of engaging and elevating. In at least some embodiments, the magnetic elevating force also maintains the snares at a predetermined distance from the snare head regardless of the snare drum orientation.

Figure 4A:
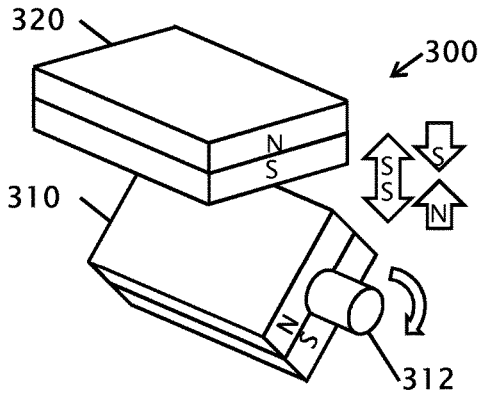
FIG. 4A shows a magnet arrangement according to at least one embodiment.
Figure 4B:
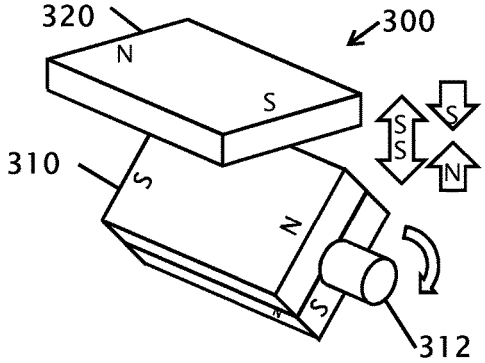
FIG. 4B shows a magnet arrangement according to at least one embodiment.
Figure 5:
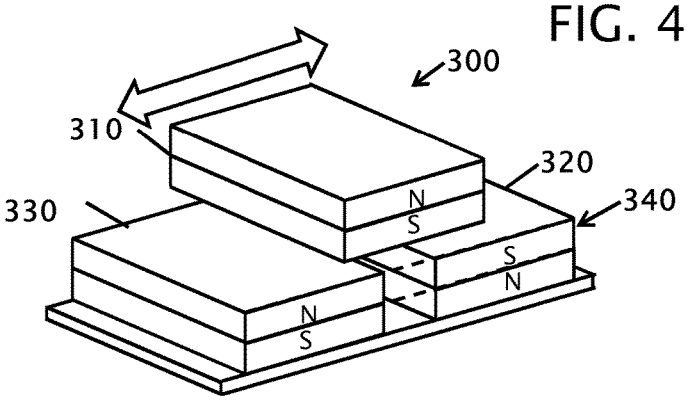
FIG. 5 shows a magnet arrangement according to at least one embodiment.

Exemplary magnet arrangements are illustrated for example in FIGS. 4-5. In the interest of clarity, the magnet arrangements are shown schematically without reference to other structural elements of the magnetic floating snare drum attachment. FIGS. 4A-B show exemplary magnet arrangements in which rotation alters the magnetic force between magnets of a magnet arrangement.

As shown in FIGS. 4A-B, the magnet arrangement includes first magnet 310 and second magnet 320 arranged such that rotation of the first magnet alters the magnetic force between the magnets. The first magnet may be controlled to rotate to control the strength and/or direction of the magnetic force between the magnets. For example, rotation of the first magnet clockwise from the shown position results in further alignment of the magnets such that the magnetic force becomes more attractive. Rotation of the first magnet counter-clockwise from the shown position results in further counter-alignment of the magnets such that the magnetic force becomes less attractive—and ultimately repulsing as the rotation of the first magnet crosses a threshold angle.

Rotation of the first magnet may be actuated manually, mechanically, and/or electrically. Preferably, the first magnet is coupled to a rotatable post 312 or other such mechanism configured to effectuate user controlled rotation of the first magnet. In some embodiments, the first magnet may be configured to rotate within a predetermined range.

FIG. 4A shows the magnets as having north (N) and south (S) poles oriented perpendicular to the axis of rotation of the rotating magnet. FIG. 4B shows the second magnet having north and south poles oriented parallel to the axis of rotation of the first magnet, and the first magnet as a stacked set of such magnets.

Figure 6:
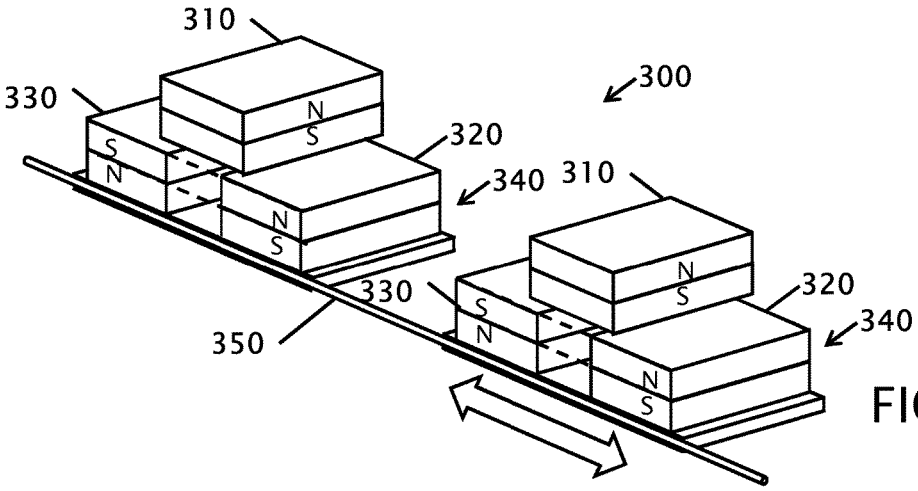
FIG. 6 shows a magnet arrangement according to at least one embodiment.

FIGS. 5-6 show exemplary magnet arrangements in which linear displacement alters the magnetic force between the magnets of the magnet arrangement.

As shown in FIG. 5, the magnet arrangement includes first magnet disposed opposite a magnet group 340. The magnet group includes a second magnet 320 and a third magnet 330. The second magnet and the third magnet are arranged in a spaced series and are counter-oriented with respect to each other.

The first magnet may be controlled to move so as to control the strength and/or direction of the magnetic force between the first magnet and the magnet group. For example, movement of the first magnet to the left from the shown position results in a greater magnetic attraction between the first magnet and the magnet group. Movement of the first magnet to the right from the shown position results in a greater magnetic repulsion between the first magnet and the magnet group.

Movement of the first magnet may be actuated manually, mechanically, and/or electrically. Preferably, the first magnet is coupled to a mechanism configured to effectuate user controlled translation of the first magnet. In some embodiments, the first magnet may be configured to traverse a predetermined range.

FIG. 6 shows a plurality of operatively coupled magnet arrangements. The magnet arrangements preferably form a spaced apart linear series. The spacing is preferably such that the respective magnet arrangements remain operatively self-contained during the translational movement. That is to say that the spacing is sufficient for the translated first magnet of one magnet arrangement not engage with the magnet group of the other magnet arrangement.

A control element 350 may couple respective magnet arrangements such that their first magnets translate and/or rotate together. This permits coordinated control of the respective magnet arrangements. Respective magnet arrangements may, for example, correspond to opposing magnetic floating snare drum attachments. In some embodiments, the control element comprises a control rod coupling respective magnet arrangements. In some embodiments, the control element may traverse the snare head. In some embodiments, the control element may circumscribe the snare head.

As discussed, the magnet arrangement displaces the moving portion towards and away from the mounted portion. Accordingly, in some embodiments, the moving portion is secured to the second magnet, and the mounted portion is secured to the first magnet, such that the controlled magnetic force between the magnets causes the desired displacement. The moving portion may, however, be secured to the first magnet and the mounted portion may be secured to the second magnet. It will be understood that the magnet arrangement may include any configuration of magnets, the control of which enables and controls the relative displacement of the moving portion towards and away from the mounted portion. Embodiments are, for example, contemplated wherein the first magnet and the second magnet are both rotatable. Embodiments are also contemplated wherein both the first magnet and the magnet group are displaceable. Embodiments are also contemplated wherein the second and third magnets are a single magnet whose polar axis is parallel to the translation axis. Variations are also contemplated for different magnets of varying size and shape.

Figure 7:
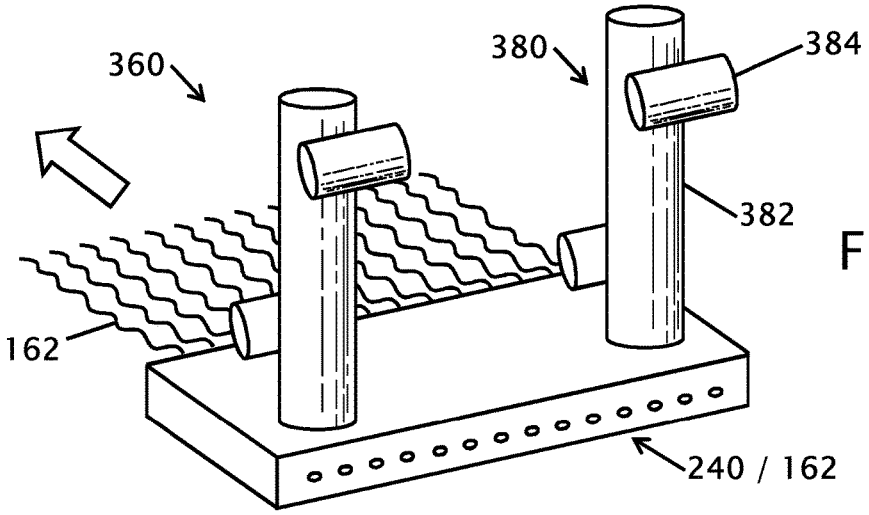
FIG. 7 shows a constraint system according to at least one embodiment.
Figure 8:
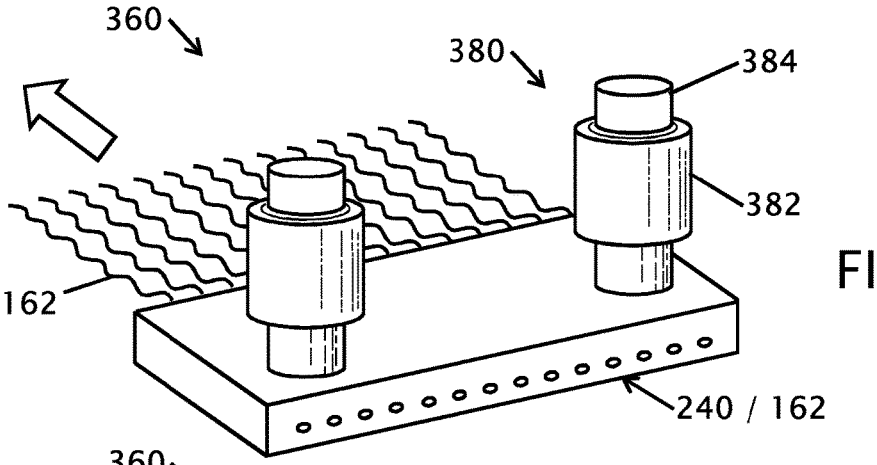
FIG. 8 shows a constraint system according to at least one embodiment.
Figure 9:
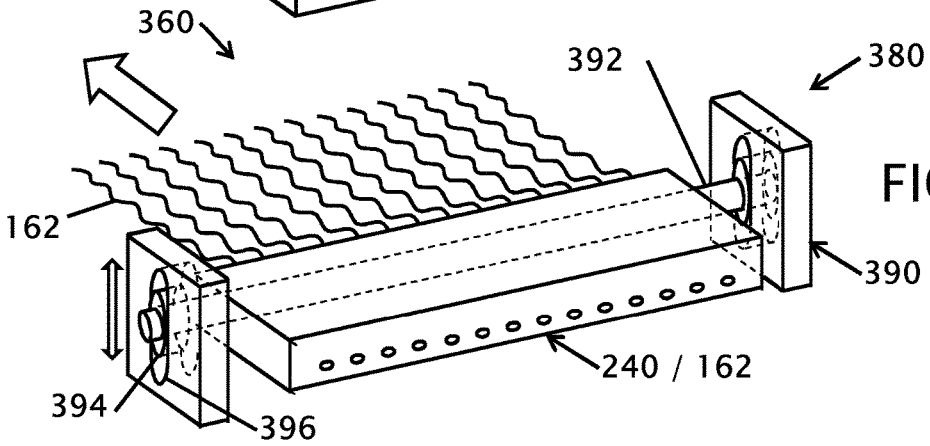
FIG. 9 shows a constraint system according to at least one embodiment.

Exemplary constraint systems are illustrated for example in FIGS. 7-9. In the interest of clarity, the constraint systems are shown schematically without reference to other structural elements of the magnetic floating snare drum attachment.

The constraint system is configured to constrain or otherwise harness the movement of the moving portion in response to the magnetic force generated by the magnet arrangement. The constraint system includes a bearing-based coupling portion 370 that couples the movable portion to the mounted portion such that the displacement of the moving portion in response to the magnetic force generated by the magnet arrangement is limited to being towards and away from the mounted portion. Accordingly, the coupling portion may comprise coupled male and female elements separated by bearings that permit relative movement between the respective male and female elements. These elements may be secured to respective portions of the magnetic floating snare drum attachment so as to permit relative movement between the respective portions.

The coupling portion may include a linear slide 380. The linear slide may comprise one or more posts 382, one more linear guides 386 and intermediate bearings 384. The posts are preferably affixed to the moveable portion (shown as snare wire retainer 164) so as to be moveable therewith. The linear guides are preferably affixed to the mounted portion and configured to slidably accept the posts therein. The bearings are positioned to decrease resistance between the rods and guides.

As shown in FIGS. 7-8 the movement of the snare wire retainer may be in the direction of the posts. According to at least one embodiment, however, the one or more posts may comprise an axle 392, and the linear guide may comprise a slot guide 396 coupled to the axle via bearings 394, as shown for example in FIG. 9. In such embodiments, movement of the snare wire retainer may be in the direction perpendicular to the axle. FIGS. 7-8 also show cylindrical bearings and linear bearings, but bearings and bearing systems of all types are expressly contemplated.

Turning to FIG. 7, snare wires 162 may pull on the snare wire retainer. The pull of the wires exerts a torque on opposing ends of the posts. In some embodiments, the bearings may be positioned relative to the posts so as to at least partially counteract such torque. While the bearings are described as positioned to at least partially counteract the torque, other structures, such as brushings, may be used for this purpose, alternatively, or in addition to the bearings.

In the context of FIGS. 7-9, the movable portion is shown as the snare wire retainer for clarity. It will be understood, however, that the snare wire retainer may be a separate structure that is secured to the moveable portion. In such embodiments, the snare wire retainer is preferably removeably secured to the moveable portion.

The floating attachment mounts the magnetic throw-off to the drum. FIGS. 10-21 illustrate the floating attachment according to several embodiments of the disclosed invention.

The floating attachment is preferably secured to the drum hoop or to the tension rods. Such embodiments are preferable to other embodiments where the floating attachment may be secured to the drum shell. The floating attachment may be secured to the drum hoop, the tension rods, and/or the drum shell via screws, magnets, or other fasteners.

Exemplary systems and methodologies from the same inventor/applicant May for securing drum hardware to drums exclusive of the drum shells may be found, for example, in U.S. Pat. No. 5,691,492, filed on Jan. 18, 1996; U.S. Pat. No. RE 42,487, filed on Sept. 24, 2004; U.S. Pat. No. 9,214,142, filed on Mar. 6, 2013, and U.S. application Ser. No. 14/957,391, filed on Dec. 2, 2015, the entire contents and disclosures of which are herein incorporated by reference.

The floating attachment generally comprises a floating attachment body 410 having a drum-facing surface 412 and a throw-off facing surface 414. The throw-off facing surface engages a floating attachment facing surface 226 of the mounted portion to form a mated joint. Preferably, the mated joint is a slidable mated joint.

In at least one embodiment, the throw-off facing surface and the floating attachment facing surface are slidably coupled via a coupling linear actuator 420. The throw-off facing surface and the floating attachment facing surface may comprise a tongue-and-groove joint.

In at least one embodiment, the throw-off facing surface may include a protruding ledge that engages the mounted portion to limit the movement of the mounting portion by the linear actuator with respect to the floating attachment. The engagement is preferably at or near a top surface of the mounting portion.

The floating attachment is preferably secured to the mounted portion via the coupling linear actuator that translates rotational motion of a screw member 422 into linear motion of the mounted portion so that the mounted portion is displaced with respect to the floating attachment. The coupling linear actuator may comprise a turnable knob 420*a*. The coupling linear actuator may engage the floating attachment and the mounting portion via the mated joint.

In this manner, the position of the snares with respect to the snare head may be further independently adjusted. In addition, for embodiments attached to the drum hoop, the magnetic throw-off and floating attachment may be removed wholesale with the drum hoop during replacement of the snare head. When the snare head is replaced and the drum hoop reattached, the already tuned snare is ready. The negative impact to the tuning presets that would otherwise occur during snare head replacement is therefore avoided.

Exemplary embodiments of the magnetic floating snare drum attachment are illustrated for example in FIGS. 10-21.

Figure 10:
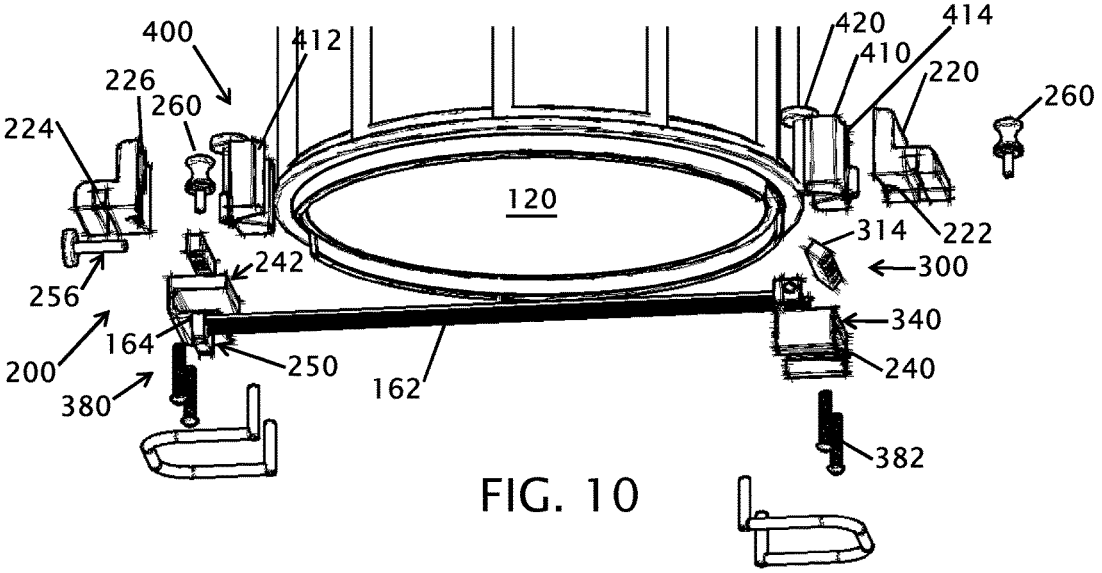
FIG. 10 shows an exploded view of a drum equipped with the magnetic throw-off and floating attachment according to at least one embodiment.

FIG. 10 shows an exploded view of the floating drum snare attachment according to at least one embodiment. Floating attachment generally couples the drum to the mounted portion, which is in turn coupled to the moving portion via the constraint system.

The mounted portion generally comprises a mounted portion body 220 that at least partially houses the magnet arrangement therein. The mounted portion body preferably includes a bottom surface 222 that defines a channel 224. The channel is configured to slidably accept a magnet-housing 314. The magnet-housing houses the first magnets of at least one magnet arrangement.

The magnet-housing is preferably in the form of a bar having recesses for fixedly accepting the first magnets therein according to the magnet arrangement. The magnet-housing is further configured to slide in a controlled manner longitudinally along the channel. A control mechanism 260 may be provided to effectuate user controlled sliding of the magnet-housing.

The control mechanism may comprise a control knob 262 coupled to the magnet-housing via a rod 264 extending through an aperture 266 of the mounted portion body such that the control knob protrudes from the mounted portion body and is graspable by a user.

Figure 11:
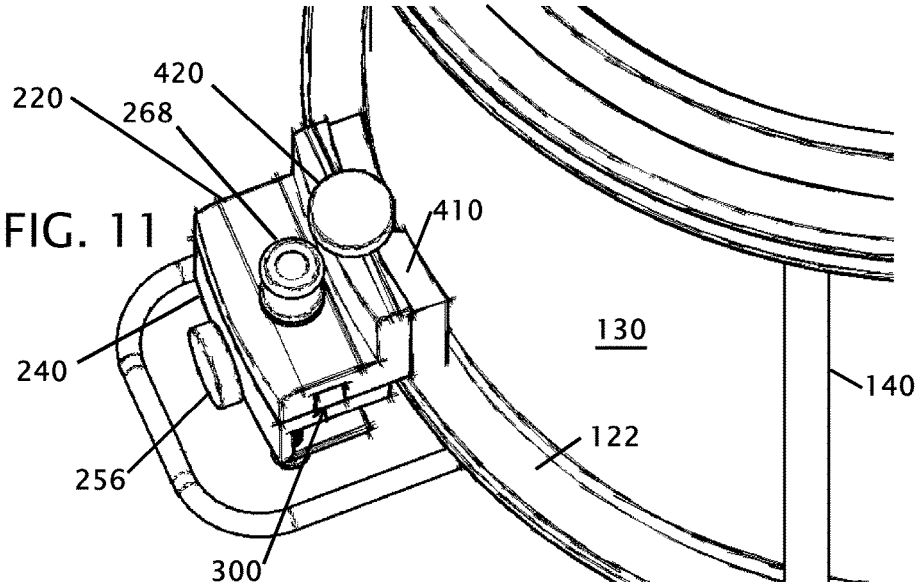
FIG. 11 shows a drum equipped with the magnetic throw-off and floating attachment according to at least one embodiment.
Figure 12:
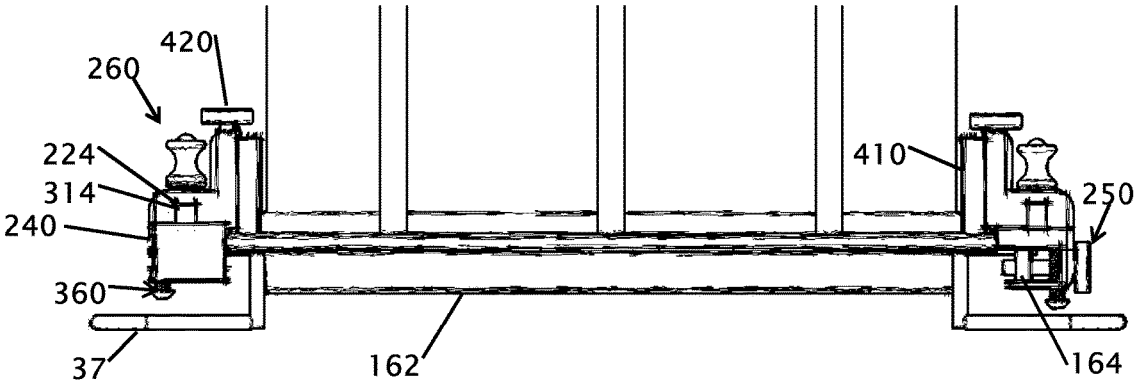
FIG. 12 shows a drum equipped with the magnetic throw-off and floating attachment according to at least one embodiment.

As shown in FIGS. 10-12, the aperture may be a slot aperture 266*a* that is elongated in the longitudinal direction of the channel such that sliding of the control knob within the slot aperture slides the magnet-housing within the channel according to the operation of the magnet arrangement. In some embodiments, the aperture is not a slot aperture, and magnet-housing is configured to slide via a pressing/pulling action on the control knob in the longitudinal direction of the channel.

The control mechanism may also include a linear actuator 268 that controls the magnet-housing to slide in an inward/outward direction perpendicular to the longitudinal direction of the channel. For example, the rod may comprise a screw that, when turned via the control knob, screws/unscrews the magnet-housing such that the magnet-housing is moved inward/outward of the channel by the action. Alternatively, the linear actuator may comprise an auxiliary control knob 270 coupled to the magnet-housing via an auxiliary screw 272, and configured such that turning the control knob screws/unscrews the magnet-housing to move inward/outward of the channel.

The movable portion generally comprises a movable portion body 240 that also at least partially houses the magnet arrangement therein. The moveable portion body preferably includes a top surface 242 that faces the bottom surface of the mounted portion body. The top surface houses the magnet group (or the second magnet) of the at least one magnet arrangement.

The movable portion body is preferably coupled to the moveable portion via the constraint system.

FIGS. 10-12 show the constraint system in the form of a linear guide using linear bearings. Posts secured to the top surface of the moveable portion body extend towards the bottom surface of the mounted portion body. The moveable portion is coupled to the posts via linear bearings secured to the moveable portion. The length of the posts is such that the linear bearings are free to permit the moveable portion body to move towards/away from the mounted portion body according to the magnetic force of the magnet arrangement. Alternative embodiments are contemplated in which the posts are secured to the mounted portion and the linear bearings are secured to the movable portion.

The floating attachment generally comprises a floating attachment body 410 having a drum-facing surface 412 and a throw-off facing surface 114. Drum attachment hardware couples the drum-facing surface to the drum. The throw-off facing surface engages a floating attachment facing surface 226 of the mounted portion body to form a mated joint. The throw-off facing surface and the floating attachment facing surface are slidably coupled via the coupling linear actuator.

As shown in FIGS. 10-12, a snare tension mechanism 250 may be provided. The snare tension mechanism comprises the snare retainer housed within the moving portion such that it may be displaced so as to alter the tension of the snare wires. In some embodiments, the moving portion includes a channel in which the snare retainer is housed. A tension screw 256 may be provided that screwedly engages the snare retainer through an aperture in the mounting portion such that turning of the tension screw causes the tensioning/untensioning displacement of the snare retainer.

Figure 13:
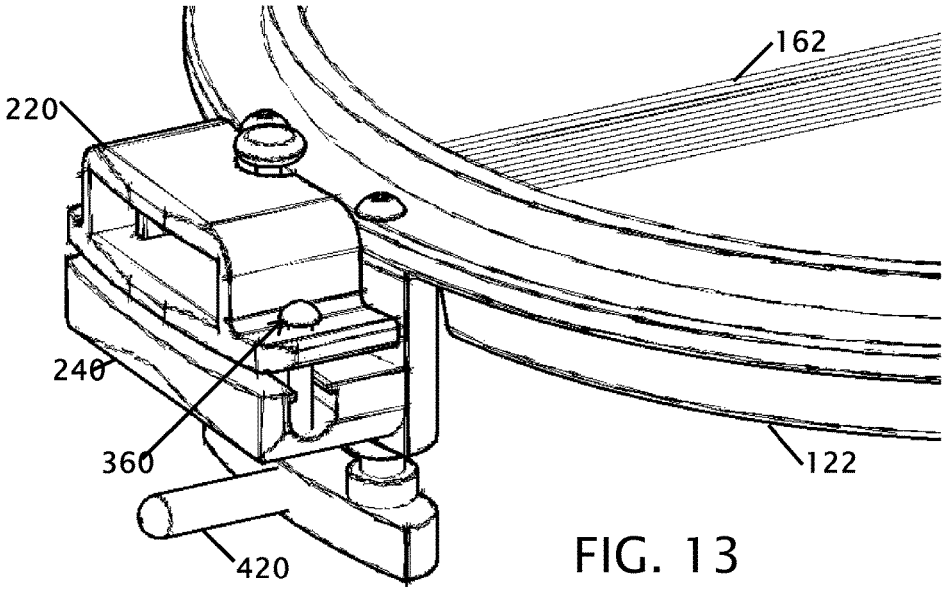
FIG. 13 shows a drum equipped with the magnetic throw-off and floating attachment according to at least one embodiment.
Figure 14:
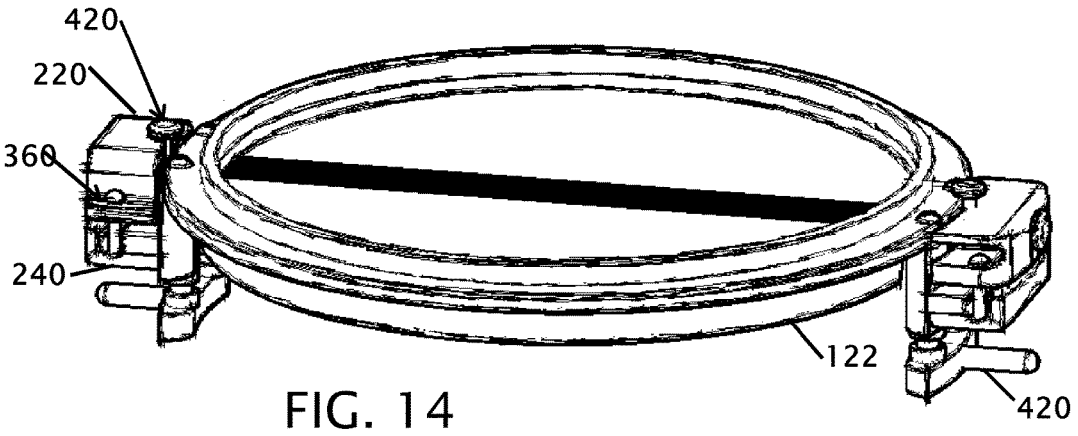
FIG. 14 shows a drum equipped with the magnetic throw-off and floating attachment according to at least one embodiment.
Figure 15:
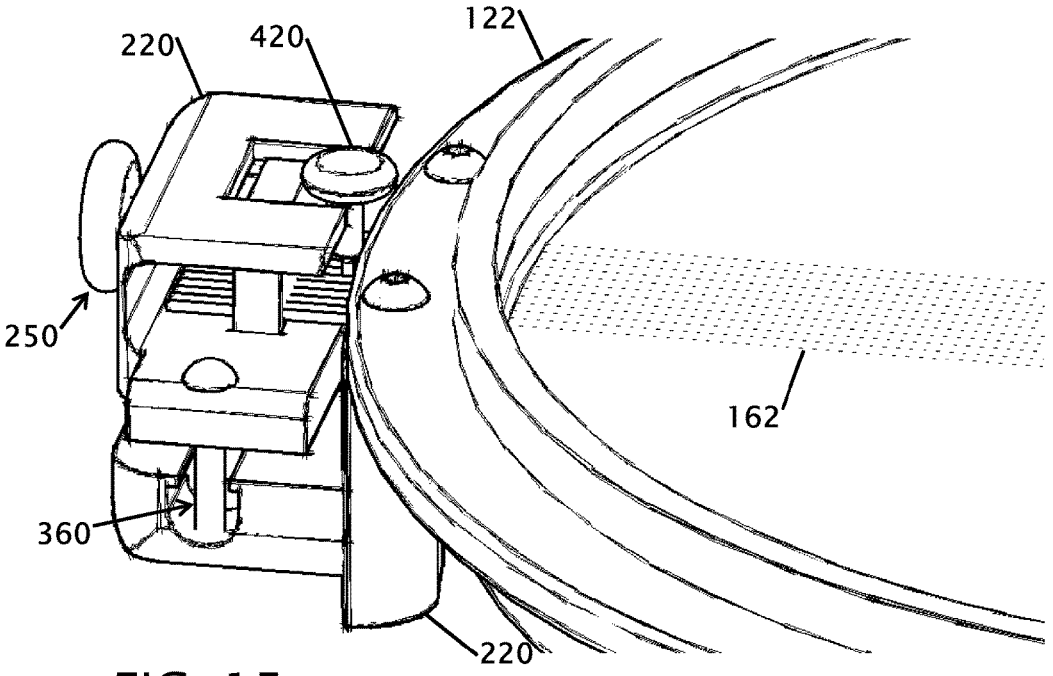
FIG. 15 shows a drum equipped with the magnetic throw-off and floating attachment according to at least one embodiment.

FIGS. 12-13 show the control mechanism 260 comprising a handle 420*b* coupled to the moving portion such that the user may manually overcome the magnetic attraction force of the magnet arrangement directly. The handle is also useable to bring the moving portion sufficiently close to the mounted portion that the respective magnets re-engage.

Figure 16:
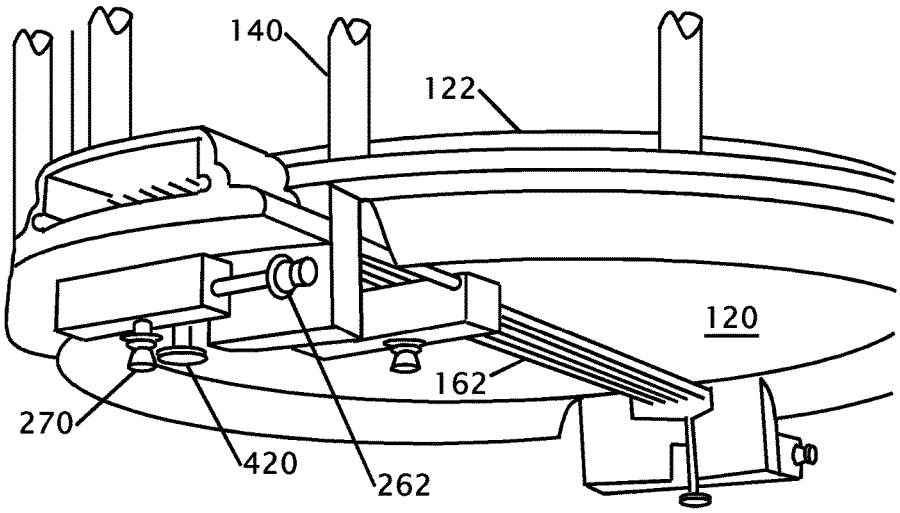
FIG. 16 shows a drum equipped with the magnetic throw-off and floating attachment according to at least one embodiment.

FIG. 16 shows adjustment controls 43 and 44 that allow for precision movement of the magnets to zero the attraction and repelling null position in accordance the concepts discussed herein. As discussed herein, it is also contemplated that the orientation of the magnetic throw-off is such that the magnetic force suspends the snares from the snare head while the drum is in a snare-head down orientation, as shown, for example, in FIG. 16. In at least one embodiment, the magnetic throw-off is coupled to an underside of the drum hoop, as shown, for example, in FIG. 16. In at least one embodiment, the magnetic throw-off is coupled to a topside of the drum hoop.

Figure 17:
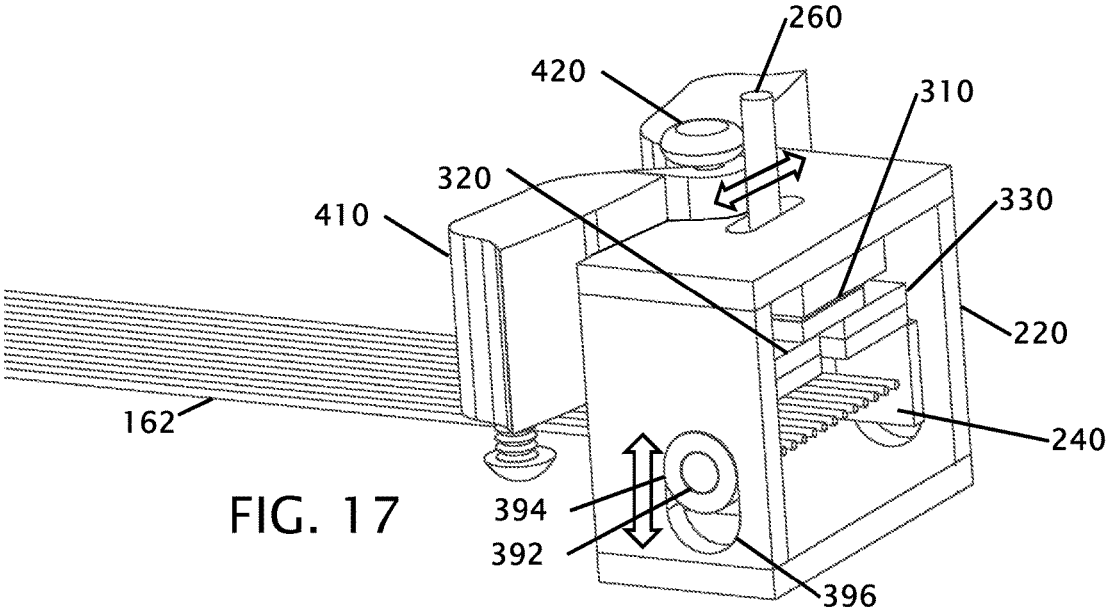
FIG. 17 shows a drum equipped with the magnetic throw-off and floating attachment according to at least one embodiment.

Turning now to FIG. 17, the magnetic throw-off according to at least one embodiment incorporating the inventive concepts of FIGS. 2, 5 and 9, discussed herein.

The magnet group is secured to the movable member that includes the snare retainer. The moveable member is slidably coupled to the mounted member via the slot slide constraint system that provides free up/down movement of the mounted member supporting axle within the slot. The first magnet is slidably secured to the mounted member. The control knob is configured to slide the first magnet to the left and right to the extent permitted by the slot aperture.

To achieve the engaged state, the control knob is actuated to slide the first magnet so as to generate sufficient attractive magnetic force to pull the moveable member up within the slot, thereby moving the snare wires closer to the snare head. To achieve the elevated state, the control knob is actuated to slide the first magnet so as to generate sufficient repulsive magnetic force to push the moveable member down within the slot, thereby moving the snare wires further from the snare head. Further adjustment may be had by turning the coupling linear actuator so as to move the mounted portion up/down with respect to the floating attachment.

Figure 18:
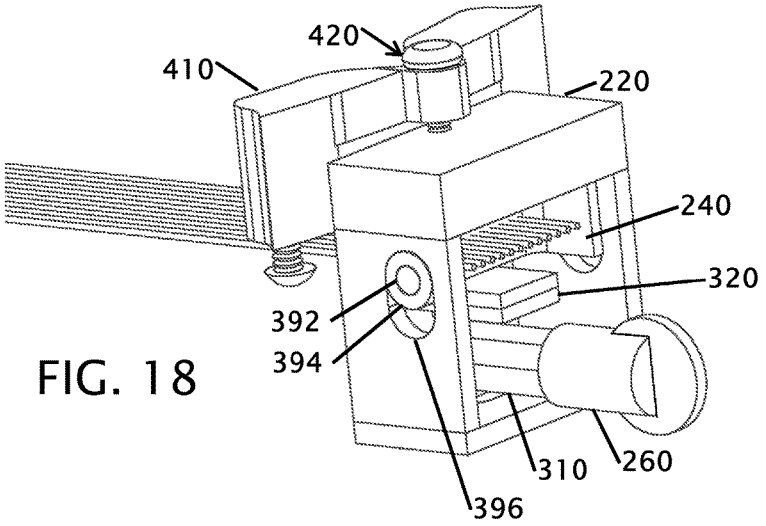
FIG. 18 shows a drum equipped with the magnetic throw-off and floating attachment according to at least one embodiment.

Turning now to FIG. 18, the magnetic floating snare drum attachment according to at least one alternative embodiment will be described. The embodiments described with reference to FIG. 18 incorporate the inventive concepts of FIGS. 2, 4A and 9, discussed herein.

The second magnet is secured to the movable member that includes the snare retainer. The moveable member is slidably coupled to the mounted member via the slot slide constraint system that provides free up/down movement of the mounted member supporting axle within the slot. The first magnet is rotatably secured to the mounted member. The control knob is configured to rotate the first magnet.

To achieve the engaged state, the control knob is actuated to rotate the first magnet so as to generate sufficient attractive magnetic force to pull the moveable member down within the slot, thereby moving the snare wires closer to the snare head. To achieve the elevated state, the control knob is actuated to rotate the first magnet so as to generate sufficient repulsive magnetic force to push the moveable member up within the slot, thereby moving the snare wires further from the snare head. Further adjustment may be had by turning the coupling linear actuator so as to move the mounted portion up/down with respect to the floating attachment.

Figure 19:
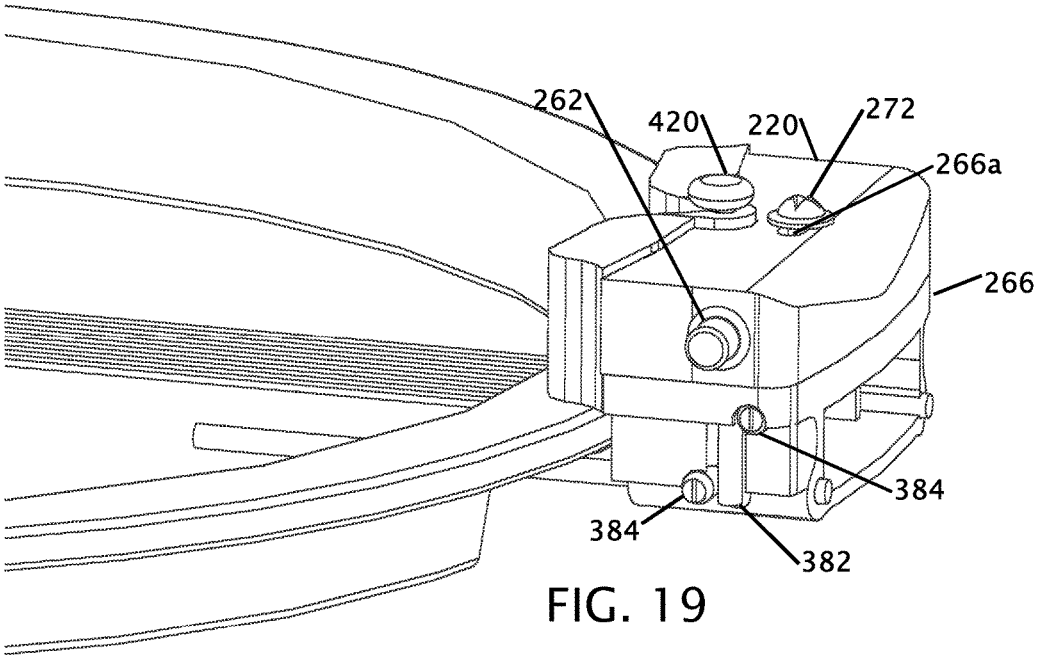
FIG. 19 shows a drum equipped with the magnetic throw-off and floating attachment according to at least one embodiment.

Turning now to FIG. 19, the magnetic floating snare drum attachment according to at least one embodiment will be described. The embodiments described with reference to FIG. 19 incorporate the inventive concepts of FIGS. 2, 5 and 7, discussed herein.

The magnet group is secured to the movable member that includes the snare retainer. The moveable member is slidably coupled to the mounted member via the linear slide constraint system that provides free up/down movement of the mounted member via posts and bearings. The first magnet is slidably secured to the mounted member. The control knob is configured to slide the first magnet to the left and right via pressing and pulling the control knob. The auxiliary screw is coupled to the first magnet through the slot aperture such that the slot-screw configuration limits the left/right movement of the first magnet. The auxiliary screw is also configured to screw/unscrew the first magnet, thereby adjusting the distance between the first magnet and the magnet group.

To achieve the engaged state, the control knob is actuated to slide the first magnet so as to generate sufficient attractive magnetic force to pull the moveable member up via the linear slide, thereby moving the snare wires closer to the snare head. To achieve the elevated state, the control knob is actuated to slide the first magnet so as to generate sufficient repulsive magnetic force to push the moveable member down via the linear slide, thereby moving the snare wires further from the snare head. Further adjustment may be had by screwing/unscrewing the auxiliary screw thereby adjusting the distance between the first magnet and the magnet group. Still further adjustment may be had by turning the coupling linear actuator so as to move the mounted portion up/down with respect to the floating attachment.

Figure 20:
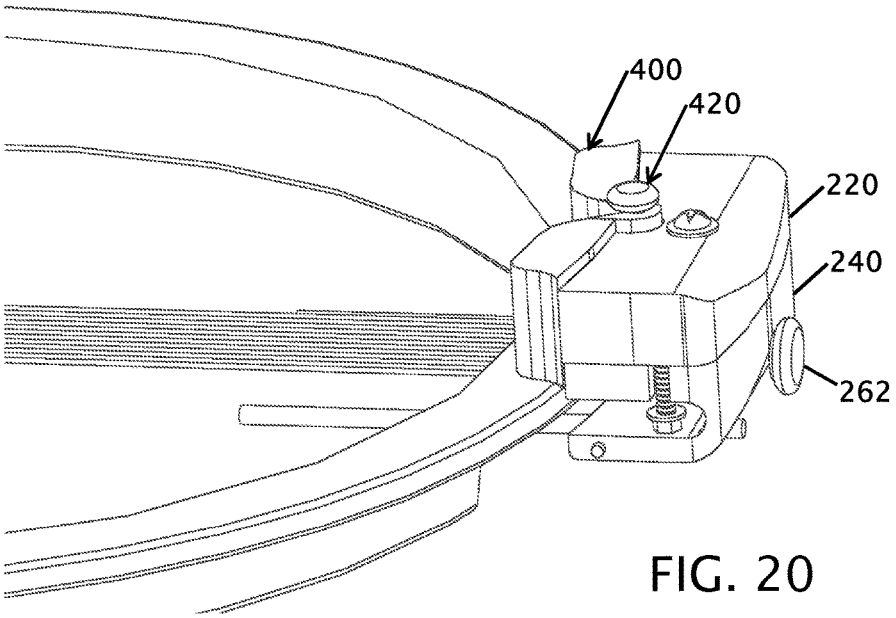
FIG. 20 shows a drum equipped with the magnetic throw-off and floating attachment according to at least one embodiment.

Turning now to FIG. 20, the magnetic floating snare drum attachment according to at least one embodiment will be described. The embodiments described with reference to FIG. 20 incorporate the inventive concepts of FIGS. 2, 6 and 8, discussed herein.

Control mechanism 260 includes control knob 262 configured to linearly displace the magnet group 340 of the moveable portion 240. Linear displacement of the magnet group alters the magnetic force between the magnet group and the first magnet 310 of the mounted portion 220. Alteration of the magnetic force results in the movement of the moveable portion towards/away from the mounted portion. In some embodiments, the control knob may be pulled/pushed to cause the linear displacement of the magnet group, in accordance with the inventive concepts described herein. In at least one embodiment, the control knob also functions as the auxiliary control knob for further adjusting the position of the magnet group within the moveable portion, in accordance with the inventive concepts described herein. Linear bearings also provide smooth movement of the posts for the moveable portion to move up and down under the influence of the magnetic force.

Figure 21:
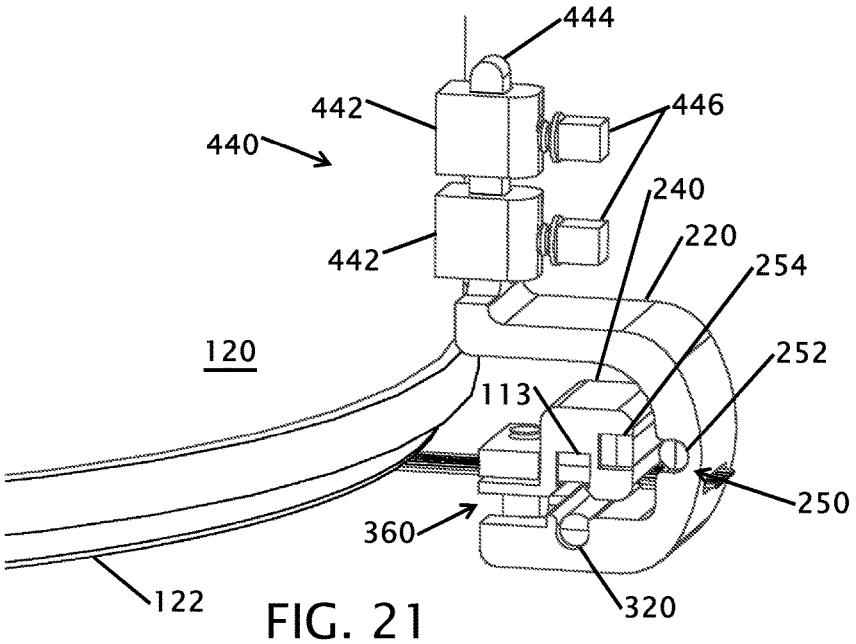
FIG. 21 shows a drum equipped with the magnetic throw-off and floating attachment according to at least one embodiment.

Turning now to FIG. 21, the magnetic floating snare drum attachment according to at least one embodiment will be described. The embodiments described with reference to FIG. 21 incorporate the inventive concepts of FIGS. 3, 4A and 8, discussed herein.

The second magnet is secured to the movable member that includes the snare retainer. The moveable member is slidably coupled to the mounted member via linear slide constraint system that provides free up/down movement of the mounted member via posts and bearings. The first magnet is rotatably secured to the mounted member. The control knob (not shown) is configured to rotate the first magnet.

To achieve the engaged state, the control knob is actuated to rotate the first magnet so as to generate sufficient repulsive magnetic force to push the moveable member up via the linear slide, thereby moving the snare wires closer to the snare head. To achieve the elevated state, the control knob is actuated to rotate the first magnet so as to generate sufficient attractive magnetic force to pull the moveable member down via the linear slide, thereby moving the snare wires further from the snare head.

FIG. 21 also shows a snare tension mechanism 250 that operates on the magnet arrangement principles disclosed herein. In particular, the magnetic snare tension mechanism comprises a first tension magnet 252 and a second tension magnet 254 operating according to the principles of FIGS. 4A and 8.

To increase the tension on the snare wires, a tension control knob (not shown) is actuated to rotate the first tension magnet so as to generate the magnetic force corresponding to a desired position of the moving member that corresponds to a desired level of tension on the snare.

FIG. 21 also shows the floating attachment of at least one embodiment coupling the magnetic throw-off to the drum shell. The floating attachment comprises one or more shell mounts 442, one or more mounting support structures 444, and one or more adjustable fasteners 446. The shell mounts are mounted to the drum shell proximate the snare head. The shell mounts are configured to receive the mounting support structures such that the relative position of the shell mounts and the mounting support structures is adjustable. The fasteners are configured to adjustably fix the relative position of the shell mounts and the mounting support structures. The mounting support structures are in turn coupled to the mounted portion of the magnetic throw-off.

For example, FIG. 21 illustrates a sliding support structure having a bar that is inserted into aligning apertures of the shell mounts and is held in place by the fasteners. Sliding the bar adjusts the distance between the snares and the snare head.

The embodiments described herein refer to the user of magnetic forces for attracting and repelling the snares to switch between engaged and elevated states with respect to the snare head. In some embodiments, however, negating the snare-engaging magnetic force may be sufficient to put the snares in the elevated state. For example, gravitational or spring forces may be relied on to create a force bias towards the elevated state that is overcome by the magnetic force. A force bias towards the engaged state is also contemplated.

It will be understood that the described embodiments are presented for illustrative purposes and that all combinations and/or permutations of the disclosed features are expressly contemplated. To the extent similar features, structures and/or elements are common across embodiments, those features, structures and/or elements are discussed in particular embodiments only where such discussion is considered helpful to an understanding of the particular embodiments. As used herein, objective orientation terms (e.g., up, down, side, etc.) are generally used with respect to the orientation of the figures as shown. These terms are not intended to necessarily suggest an objective orientation of the described elements with respect to gravity.

The enabled features described in detail above are considered novel over the prior art of record and are considered critical to the operation of at least one aspect of the invention and to the achievement of the objectives of the invention. The words used in this specification to describe the exemplary embodiments are to be understood not only in the sense of their commonly defined meanings, but also to include any special definition with regard to structure, material or acts that would be understood by one of ordinary skilled in the art to apply in the context of the entire disclosure.

The definitions of the words or drawing elements described herein are meant to include not only the combination of elements which are literally set forth, but all equivalent structures, materials or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim without departing from the scope of the invention.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted in conjunction with the appended claims.

What is claimed is:

1. A snare drum attachment, comprising:

a snare movement structure mountable to the snare drum and mountable with snares of the snare drum, the snare movement structure having at least one magnet element, the snare movement structure configured to set the snares of the snare drum at a snare effect level; and an actuator that controls the at least one magnet element to adjust the snare effect level via an alteration of a magnetic force acting between portions of the snare movement structure.

2. The snare drum attachment of claim 1, wherein the snare movement structure includes at least a first portion configured to float via the magnetic force with respect to the mounted body.

3. The snare drum attachment of claim 1, wherein the snare effect level associated with the magnetic force is irrespective of the orientation of the snare drum.

4. The snare drum attachment of claim 1, wherein the alteration of the magnetic force via the actuator transitions the snare movement structure between an engaged state, in which the snares are nearer to the snare head, and an elevated state, in which the snares are further from the snare head.

5. The snare drum attachment of claim 4, wherein the snare effect level of the elevated state is irrespective of the orientation of the drum.

6. The snare drum attachment of claim 1, wherein the actuator is configured to rotate the at least one magnet so as to alter the magnetic force via the rotation.

7. The snare drum attachment of claim 1, wherein the manual actuator is configured to linearly displace the at least one magnet so as to alter the magnetic force via the linear displacement.

8. A method for controlling a set distance between a snare head of a snare drum and tensioned snares of the snare drum, the method comprising:

mounting a snare drum attachment to the snare drum and the snares to the snare drum attachment, the snare drum attachment comprising: a mounted body via which the snare drum attachment is mounted to the snare drum, and a moveable body coupled to the mounted body and retaining the tensioned snares the set distance from the snare head;

displacing the moveably body relative to the mounted body via an alteration of a magnetic force acting between the moveably body and the mounted body, the displacement thereby changing the set distance of the tensioned snares from the snare head.

9. The method of claim 8, wherein the moveable body floats via the magnetic force with respect to the mounted body.

10. The method of claim 8, wherein the set distance associated with the magnetic force is irrespective of the orientation of the snare drum.

11. The method of claim 8, wherein the alteration of the magnetic force displaces the moveable body between an engaged state, in which the snares are nearer to the snare head, and an elevated state, in which the snares are further from the snare head.

12. The method of claim 8, wherein the snare drum attachment further comprises: a constraint system coupling the moveable body and the mounted body, and wherein the method further comprises: physically constraining with the constraint system the movement of the moveable body via the magnetic force with respect to the mounted body.

13. The method of claim 12, wherein the constraint system comprises a linear slide.

14. The method of claim 8, wherein the snare drum attachment further comprises: a snare tension mechanism coupling the tensioned snares to the moveable body, and wherein the method further comprises: retaining the tension of the snares with the snare tension mechanism independent of the displacement of the moving body due to the magnetic force.

15. The method of claim 8, further comprising: rotating a first magnet located within the mounted body so as to alter the magnetic force via the rotation.

16. The method of claim 15, wherein the moveable body further comprises: a second magnet and a third magnet, the second and the third magnets forming a magnet group magnetically coupled to the first magnet so as to generate the magnetic force.

17. The method of claim 8, further comprising: linearly displacing a first magnet located within the mounted body so as to alter the magnetic force via the linear displacement.

18. The method of claim 17, wherein the moveable body further comprises: a second magnet and a third magnet, the second and the third magnets forming a magnet group magnetically coupled to the first magnet so as to generate the magnetic force.

19. The method of claim 8, wherein the snare drum attachment further comprises: an attachment body configured to be displaceably coupled to the mounted body, wherein mounting the snare drum attachment to the snare drum is via coupling the mounted body to the attachment body, wherein the method further comprises: displacing the mounted body with respect to the attachment body after the coupling.

20. The method of claim 19, wherein the snare drum attachment further comprises: a linear actuator coupling the attachment body to the mounted body, and wherein the method further comprises: actuating the linear actuator to control the displacement of the mounted body and the moving body with respect to the attachment body.

* * * * *